United States Patent [19]

Seidler

[11] Patent Number: 4,735,420

[45] Date of Patent: Apr. 5, 1988

[54] BALL-GAME SET

[75] Inventor: Brigitte Seidler, Stuvenborn, Fed. Rep. of Germany

[73] Assignee: Chemische Fabrik Geefa, Brigitte Seidler, Stuvenborn, Fed. Rep. of Germany

[21] Appl. No.: 927,433

[22] Filed: Nov. 6, 1986

[30] Foreign Application Priority Data

Sep. 8, 1986 [DE] Fed. Rep. of Germany ... 8624045[U]

[51] Int. Cl.[4] ..... A63B 67/00

[52] U.S. Cl. ..... 273/412; 273/346; 273/DIG. 30

[58] Field of Search ..... 273/346, 412, DIG. 30

[56] References Cited

U.S. PATENT DOCUMENTS 4,017,076 4/1977 Bai ..... 273/412

FOREIGN PATENT DOCUMENTS 103694 3/1984 European Pat. Off. .

*Primary Examiner*—William H. Grieb

*Attorney, Agent, or Firm*—Chilton, Alix & Van Kirk

[57] ABSTRACT

Ball-game set consisting of a ball and a catching disc. The surfaces of the ball and of the catching disc are covered with a mutually complementary fibre coating and burr material respectively, so that the ball striking the catching disc is retained.

8 Claims, 1 Drawing Sheet

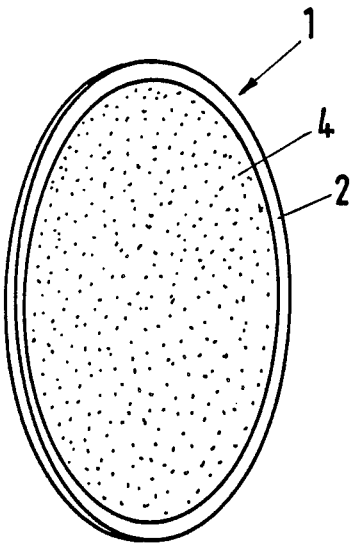
Fig. 1
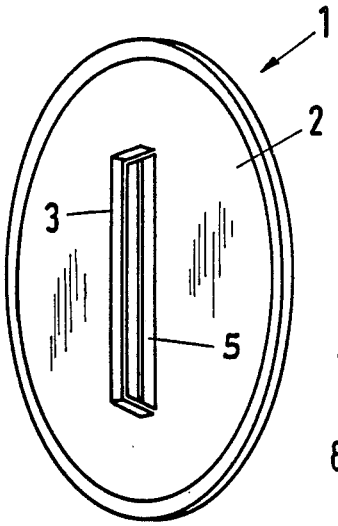
Fig. 2
Fig. 3
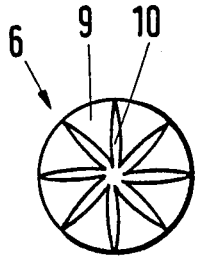
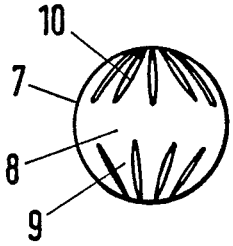
Fig. 4
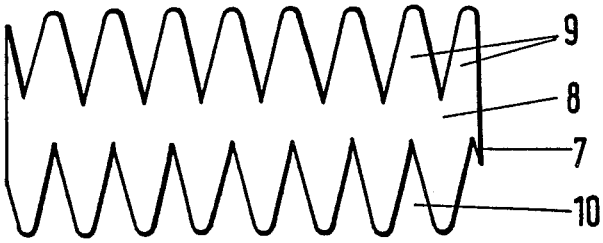
Fig. 5

BALL-GAME SET

The invention relates to a ball-game set consisting of a ball and a catching disc, the surfaces of which are designed to cling to one another.

In a known set of this type (EP-AO-No. 103,694), the ball consists of a soft plush-like material, approximately the size of a tennis ball. The catching disc is shaped like a discuss and is firmly braced with six crepe bands which are intended to ensure that the soft ball clings to it. This means that the plush-like material of the ball and the crepe material of the catching disc do not slide on one another, so that the ball striking the catching disc cannot slip off from it, but at the very most roll on it. A catching effect is achieved because the disc is held at right angles to the direction of movement of the ball which, when it strikes the catching disc, does not bounce back because its plush-like material does not have sufficient elasticity. Instead, it has to be knocked back by means of a catching disc or retained by the free hand after striking the catching disc.

The known set requires a certain skill, because catching the ball presupposes that the catching disc is held perpendicular to the direction of movement of the ball with reasonable accuracy. This skill cannot always be assumed where smaller children and inexperienced players are concerned.

The object on which the invention is based is, therefore, to provide a ball-game set which can be used without special skill and, in particular, even makes small children successful at the game.

In the solution according to the invention, the surfaces of the ball and of the catching disc carry respectively a fibre coating and burr material.

When the ball makes contact, the fibre coating of one part becomes hooked up in the burr material of the other part, so that the ball striking the catching disc is retained on the latter, and in fact largely irrespective of the arbitrary direction of the catching disc in relation to the ball. The ball can then be torn off from the catching disc again with the free hand and thrown back to the other player.

The burr material is a material usually of the textile type which is stretched out in the form of a sheet and from the surface of which protrudes a plurality of monofilamentary projections, the ends of which are bent around in hook form or are thickened in the form of small heads. The fibre coating is a sheet-like textile material, the surface of which is characterized by a plurality of loose, loop-shaped, preferably monofilamentary fibres.

Materials of this type are known and have many uses, and they therefore need not be described in more detail. The above explanations are not intended as a restriction to particular designs of burr material and fibre coating, although the designs mentioned have proved especially suitable.

It does not matter, in principle, whether the burr material is arranged on the catching disc or on the ball and accordingly whether the fibre coating is located on the ball or on the catching disc. However, it has proved expedient to arrange the fibre coating on the ball, because the fibre coating can be matched more easily to the spherical surface shape of the ball.

On the ball, the clinging material is appropriately in the form of several separate elements on a ball body which, as is known where game balls are concerned, can, but does not have to be made hollow and elastic. Appropriately, the clinging material of the ball is in strip form, and an especially advantageous design is one in which the clinging material of the ball has an essentially straight continuous equatorial strip and transverse strips extending from this and preferably pointed in a meridional direction. This makes it possible to attach it in an especially simple way, because the clinging material of the ball can first be stamped in the form of a virtually endless strip, the continuous strip first being wrapped around the ball body and fastened to it and then the transverse strips being applied towards the two poles. In a plane layout, the transverse strips extending from the strip to be arranged equatorially are appropriately separated from one another by V-shaped cut-outs.

It is not necessary that the elements forming the clinging material of the ball and attached to the ball body should adjoin one another without any spacing, although this is possible, of course, if production is suitably accurate. Instead, it is more expedient to provide certain spacings and gaps between the elements, because this makes it much easier to attach them to the ball body. However, the gaps should not be so large as to affect adversely the clinging capacity on the catching disc as a result. This condition is usually satisfied if the transverse dimensions of the gaps are no longer than approximately four times the thickness of the clinging material. The transverse dimension of a gap refers to the minimum distance between two adjacent elements of clinging material at any point of the gap considered.

The clinging material on the ball has a thickness of appropriately 2 to 5 mm. At the same time, the maximum transverse dimension of the gaps should not exceed approximately 12 mm.

The clinging material of the ball is appropriately a sheet-like material which, on its rear side to be connected to the ball body, carries a pressure-sensitive adhesive, that is to say an adhesive layer which is effective without special chemical or thermal activation. This makes it simpler to attach the clinging material to the ball body.

The catching disc can consist of a supporting plate which is equipped with a strap handle and on which the sheet-like burr material is fastened, for example by means of a layer of pressure-sensitive adhesive located on its rear side. A highly expedient form of the catching disc is that (known per se) in which the handle is arranged in the middle of the supporting plate on one side, whilst the other side carries the burr material. However, it is also possible to provide the catching disc in a manner of a tennis racquet with a handle arranged laterally relative to the plane of the plate. The burr material can then be provided on both sides.

If the handle is arranged in the centre on one side of the catching disc, it is expedient to make in the supporting plate, underneath the strap handle, a cut-out which has at least the size of the contour of the strap handle, so that the supporting plate can be produced economically in a two-part injection mould or by being stamped out and deep-drawn from a plane sheet.

According to a further feature of the invention, the burr material rests directly on the supporting plate, so that it is supported more or less rigidly by the supporting plate. This has proved expedient to ensure that the ball clings securely to the catching disc, even when it is very light and/or strikes the latter at very low speed.

The invention is explained in detail below with reference to the drawing which illustrates an advantageous exemplary embodiment. In the drawing:

FIGS. 1 and 2 show the catching disc in a perspective representation obliquely from the front and obliquely from the rear respectively, FIGS. 3 and 4 show the ball in a polar view and transversely relative to this respectively, and FIG. 5 shows a strip of clinging material, as used for equipping the balls according to FIGS. 3 and 4.

The catching disc (1) consists of a plastic plate (2) with a handle (3) and the burr material (4) glued onto the side away from the handle (3). The disc is essentially plane, but, if desired, it can also be made slightly concave or convex. It is limited circularly, and its surface area corresponds approximately to two adult palms of the hand. The supporting plate (2) has, underneath the strap handle (3), a cut-out (5) which corresponds approximately to the contours of the strap handle (as seen in a vertical plan view) and which, according to known principles, makes it possible to achieve a simple method of production. The burr material (4) is bonded to the supporting plate (1), for example, by means of a pressure-sensitive adhesive which is provided on the rear side of the burr material and which can be permanently active.

The ball (6) contains a spherical ball body which, for example, is an elastically flexible plastic hollow body. Attached as a clinging material to its surface is the fibre coating (7) which, in the example illustrated, consists integrally of an equatorial strip (8) and transverse strips (9) extending from this and which is fastened to the ball body by means of a pressure-sensitive adhesive located on the rear side of the fibre coating. There is no need for a high adhesive strength; it merely has to be greater than the clinging strength obtained between the fibre coating and the burr material, so that when the ball is released from the catching disc the clinging material cannot come loose from the ball body.

To avoid having to achieve an accuracy causing problems when the clinging material is attached to the ball body, the transverse strips (9) are limited so that gaps (10) can remain between them, the width of these gaps being limited so that, even when the ball strikes the catching disc in the most unfavourable possible way, a sufficient proportion of the fibre coating on both sides of the gaps always comes in contact with the burr material of the catching disc. To achieve the aim of easy assembly, it is sufficient if the gaps (10) between the transverse strips (9) have a width in the centre of approximately 1 to 5 mm. Depending on the thickness of the fibre coating, larger gaps (especially at the poles) up to a size of 10 mm are also acceptable.

FIG. 5 shows the shape of the clinging material to be attached to the ball, in a strip of a length corresponding to the circumference of the ball. It can be seen that essentially triangularly limited transverse strips (9) are attached to the equatorial strip (8). No special skill is required first to wrap the strip (9) equatorially round the ball sufficiently in the centre and subsequently to attach the transverse strips (9) so as to point towards the poles.

I claim:

1. A ball-game set comprising:

a catching disc (1) including a substantially rigid, plastic support plate (2) having a front side and a back side, the front side having an uncushioned burr material (4) resting thereon, the back side having a cut-out (5) and a strap handle (3) integral with the plate, formed over the cut-out; and a ball (6) having a hollow, elastic body and sheet-like clinging material (7) arranged in the form of several separate elements (8, 9) on the ball body, the clinging material having an underside provided with pressure sensitive adhesive for connecting the clinging material to the body and a top side provided with a fiber coating for engaging the burr material on the catching disc, whereby the ball is retained by the disc upon contact with the front side thereof.

2. Ball-game set according to claim 1, characterized in that the clinging material (7) of the ball is in strip form.

3. Ball-game set according to claim 2, characterized in that the clinging material (7) of the ball has an essentially straight continuous equatorial strip (8) and transverse strips (9) extending from this.

4. Ball-game set according to claim 3, characterized in that, in a planar layout, the transverse strips (9) are separated from one another by V-shaped cut-outs (10).

5. Ball-game set according to claim 4, characterized in that the elements (9) of the clinging material of the ball (6) are separated from one another by gaps (10), the transverse dimensions of which are no larger than approximately four times the thickness of the clinging material (7).

6. Ball-game set according to claim 3, characterized in that the clinging material (7) of the ball (6) is approximately 2 to 5 mm thick.

7. Ball-game set according to claim 1 characterized in that the elements (9) of the clinging material of the ball (6) are separated from one another by gaps (10), the transverse dimensions of which are no larger than approximately four times the thickness of the clinging material (7).

8. Ball-game set according to claim 1 characterized in that the clinging material (7) of the ball (6) is approximately 2 to 5 mm thick.

* * * * *